US006045487A

United States Patent [19]

Miller

[11] Patent Number: 6,045,487

[45] Date of Patent: Apr. 4, 2000

[54] EXERCISE APPARATUS

[76] Inventor: Larry Miller, 4030 Oaktree Cir., Rochester, Mich. 48306

[21] Appl. No.: 09/016,659

[22] Filed: Jan. 30, 1998

Related U.S. Application Data

[63] Continuation-in-part of application No. 08/795,036, Feb. 5, 1997, Pat. No. 5,911,649, which is a continuation of application No. 08/636,074, Apr. 22, 1996, Pat. No. 5,611,756, which is a continuation-in-part of application No. 08/598,548, Feb. 8, 1996, Pat. No. 5,577,985

[60] Provisional application No. 60/041,742, Mar. 28, 1997.

[51] Int. Cl.[7] ..... A63B 69/16; A63B 22/04

[52] U.S. Cl. ..... 482/52; 482/51

[58] Field of Search ..... 482/51, 52, 53, 482/57, 70, 71

[56] References Cited

U.S. PATENT DOCUMENTS

| | | | |
|---|---|---|---|
| 2,603,486 | 7/1952 | Hughes | 273/79 |
| 3,316,898 | 5/1967 | Brown | 128/25 |
| 4,185,622 | 1/1980 | Swenson | 128/25 |
| 4,509,742 | 4/1985 | Cones | 272/73 |
| 4,720,093 | 1/1988 | Del Mar | 272/70 |
| 5,039,088 | 8/1991 | Shifferaw | 272/73 |
| 5,242,343 | 9/1993 | Miller | 482/57 |
| 5,383,829 | 1/1995 | Miller | 482/57 |
| 5,518,473 | 5/1996 | Miller | 482/57 |
| 5,562,574 | 10/1996 | Miller | 482/51 |
| 5,735,773 | 8/1998 | Vittone | 482/52 |
| 5,766,113 | 6/1998 | Rodgers | 482/52 |
| 5,779,598 | 1/1998 | Lee | 482/51 |
| 5,788,610 | 8/1998 | Eschenbach | 482/52 |
| 5,792,026 | 8/1998 | Maresh et al. | 482/57 |

FOREIGN PATENT DOCUMENTS 2919494 11/1980 Germany .

*Primary Examiner*—Stephen R. Crow

*Attorney, Agent, or Firm*—Gifford, Krass, Groh, Sprinkle, Anderson & Citkowski, P.C.

[57] ABSTRACT

An exercise apparatus includes a set of guide links pivotally supported thereupon. Each guide link supports a foot link at one end thereof. A control member engages each foot link and the apparatus also includes a reciprocating assembly which engages and reciprocates the control members so as to move the associated foot links up and down as the guide links pivot back and forth. This produces an overall elliptical motion in each of the foot links.

14 Claims, 4 Drawing Sheets

EXERCISE APPARATUS

RELATED APPLICATIONS AND PATENTS

This patent application claims priority of provisional patent application Serial No. 60/041,742 filed Mar. 28, 1997, entitled "Exercise Apparatus," and is a continuation-in-part of patent application Ser. No. 08/795,036 filed Feb. 5, 1997 now Pat. No. 5,911,649 and entitled "Stationary Exercise Device," which is a continuation of Ser. No. 08/636,074, now U.S. Pat. No. 5,611,756 filed Apr. 22, 1996, which is a continuation-in-part of Ser. No. 08/598,548 U.S. Pat. No. 5,577,985 filed Feb. 8, 1996.

FIELD OF THE INVENTION

This invention relates generally to exercise equipment. More specifically, the invention relates to a compact, stationary exercise device for simulating running and stepping motions.

BACKGROUND OF THE INVENTION

Because of a growing appreciation for the benefits of regular exercise; and because constraints of time and space prevent many persons from indulging in activities such as running, swimming and walking, the market for exercise equipment is rapidly increasing. It is generally desirable to exercise a number of different muscles over a fairly large range of motion so as to provide for even physical development and a maximum level of aerobic exercise. It is further desirable that exercise equipment provide a smooth, relatively natural motion so as to avoid jarring or irregular strains which can damage muscles and joints. It is also desirable that exercise equipment be relatively easy to use and of simple, low cost construction.

While a number of different exercise systems are known in the prior art, such systems suffer from a number of shortcomings which limit their utility. Stationary bicycles are widely used; however, they are employed in a sitting position and consequently, the number of muscles exercised is small. Furthermore, the range of motion provided by a stationary bicycle is fairly limited. Stationary devices for simulating cross country skiing are also in widespread use. While these systems exercise more muscles than do stationary bicycles, the relatively flat, shuffling foot motion provided thereby does not adequately exercise all of the leg muscles through a wide range of motion. Stair climbing equipment also exercises more muscles than do stationary bicycles; however, the rather limited up and down motion provided thereby does not exercise leg muscles through a large range of motion. Treadmills and the like permit walking or jogging in a relatively limited area; however, they can be quite jarring to knee and ankle joints, and many users find it difficult to maintain balance on a treadmill.

U.S. Pat. No. 4,720,093 shows a climbing type exerciser. Pat. No. 4,509,742 shows a stationary bicycle which provides for arm motion. Pat. No. 2,603,486 shows a bicycle type exerciser providing for combined arm and leg motions. Pat. No. 5,039,088 shows another bicycle type exerciser providing for hand motion.

U.S. Pat. No. 3,316,898 discloses a rehabilitation device for passive use by a seated person. The device includes a motor which raises and lowers a set of foot supporting plates so as to flex the ankle, knee and hip joints. A similar device is shown in U.S. Pat. No. 4,185,622. German Laid Open Publication 29 19 494 discloses an exercise device in which a set of foot supporting plates are disposed so as to undergo a combination of sliding and rotary motion to provide a stepping action. It has been found that while these apparatus produce a stepping motion, the motion does not simulate natural running and walking.

In response to the shortcomings of the prior art, the inventor of the present invention has previously developed a stationary exercise device which is disclosed in U.S. Pat. Nos. 5,242,343; 5,383,829; 5,518,473 and 5,562,574. The apparatus of the foregoing patents provides a natural running and stepping motion in which the user's heel initially rises at a faster rate than the toe, on a forward step, and in which the heel initially falls at a faster rate than the toe on a backward step. The present invention is directed to an exercise device which is configured differently from those in Pat. Nos. 5,242,343; 5,383,829; 5,518,473 and 5,562,574, but which achieves a similar, beneficial foot action.

The apparatus of the present invention is simple to manufacture and use, compact in design, and provides a smooth, natural action which exercises a relatively large number of muscles through a large range of motion. These and other advantages of the present invention will be readily apparent from the drawings, discussion and description which follow.

BRIEF DESCRIPTION OF THE INVENTION

There is disclosed herein an exercise device which includes a frame configured to be supported on a floor. The frame has a first and a second pivot axis defined thereupon. The apparatus further includes a first and a second guide link, each guide link has a first and a second attachment point defined thereupon, and each guide link is pivotably attached, through its first attachment point, to the frame at the first pivot axis thereof. The apparatus includes a first and a second foot link, each foot link is pivotably attached to a respective one of the first and second guide links through the second attachment point thereof. The apparatus also includes a first and a second crank arm, and each crank arm is pivotably attached to the frame at its second pivot axis so as to be rotatable thereabout. The apparatus also includes a first and second control means in mechanical communication with the crank arms and the foot links; the control means are operative to vary an angle defined between each of the foot links and its respective guide link as the guide link pivots about the first pivot axis.

In particular embodiments, the control means includes a first and second control member, each having a first junction point affixed to a respective one of the foot links, and first and second reciprocating means, each in mechanical communication with a respective one of the crank arms and with a second junction point defined on a respective one of the first and second control members. Each of the reciprocating means is operable to reciprocate the second junction point of its respective control member as its respective crank arms rotate about the second pivot axis and thereby vary the angle defined between its respective foot link and associated guide link.

In specific embodiments, the first and second reciprocating means includes a cam wheel which is mechanically coupled to a respective crank arm, and a cam follower which engages the cam wheel and is in mechanical communication with the second junction point of its respective control member, either directly or through one or more intermediate elements. In other embodiments, the reciprocating means comprise a camming arm having a first end fixed to a respective one of the crank arms and in angled relationship thereto, and a second end which is in mechanical communication with the control means.

DETAILED DESCRIPTION OF THE INVENTION

The present invention is directed to a stationary exercise device of simple construction that provides a range of motion which simulates a natural running and stepping action. The apparatus of the present invention may be implemented in a variety of configurations, and some particular configurations will be described herein, it being understood that yet other embodiments may be configured in accord with the principles of the present invention.

Figure 1:
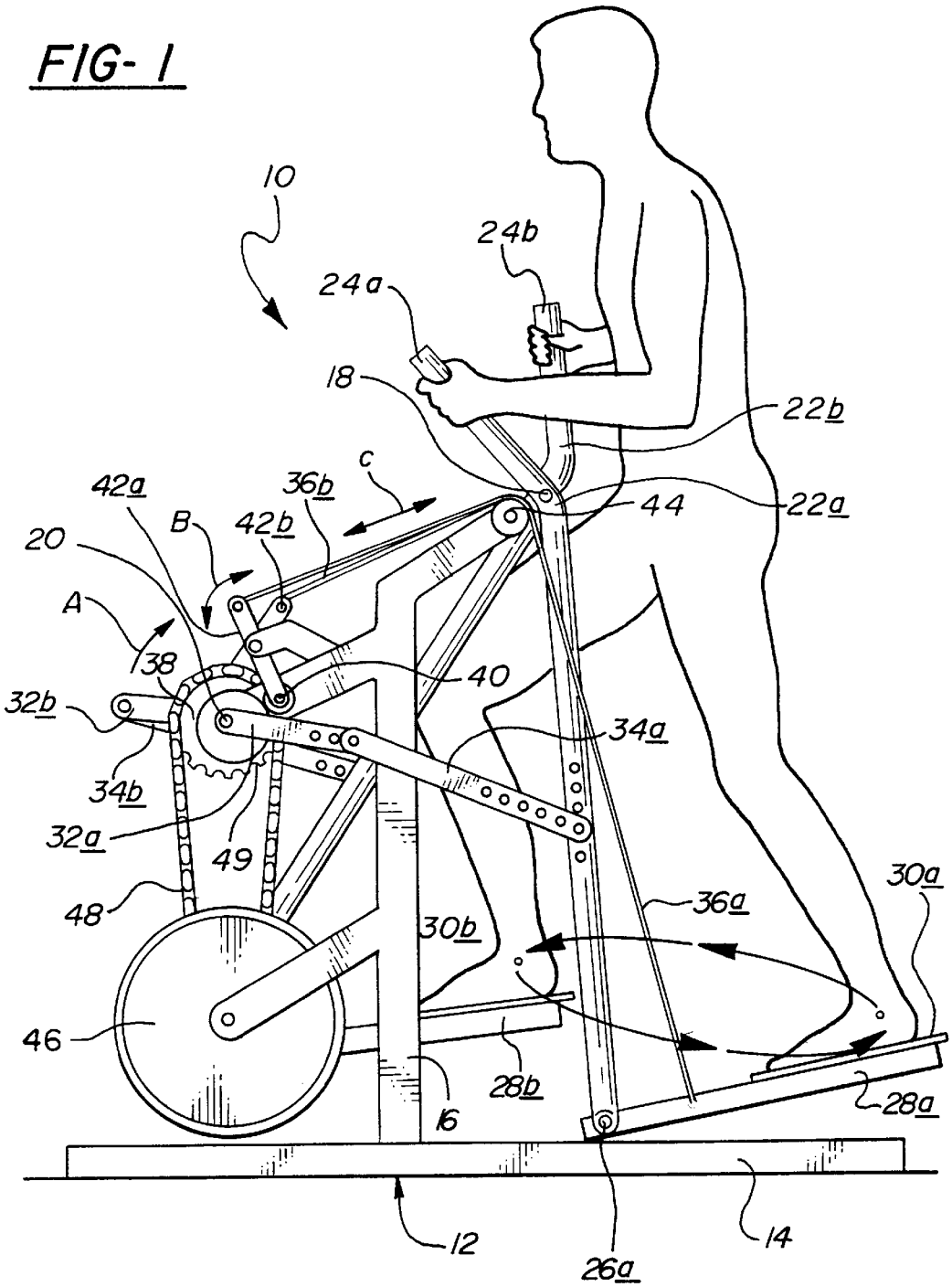
FIG. 1 is a side elevational view of one embodiment of exercise device structured in accord with the principles of the present invention.

Referring now to FIG. 1, there is shown a side elevational view of a first embodiment of exercise apparatus 10 structured in accord with the principles of the present invention. The apparatus 10 includes a frame 12 which is configured to be supported on a floor and which supports and stabilizes the remainder of the apparatus. The frame 12 includes a base 14 and an upright 16 projecting from the base 14. A first pivot axis 18 and a second pivot axis 20 are defined on the frame.

The apparatus further includes a first guide link 22*a* and a second guide link 22*b*. The two guide links 22 are generally similar, and they are pivotably attached to the frame 12 through the first pivot axis 18, at a first attachment point defined on each of the guide links 22. The guide links 22 are attached to the frame 12 so that they are capable of pivoting back and forth on the frame, and such connection is typically accomplished by a pin or axle which passes through the first pivot axis 18, and through the first attachment points of each of the guide links 22. As further illustrated, the guide links 22 each include a handle portion 24*a*, 24*b* which projects beyond the first attachment point, and is configured to be grasped by a user.

Each of the guide links 22 includes a second attachment point defined thereupon, and in the FIG. 1 drawing, the second attachment point 26*a* of the first link 22*a* is visible, while the corresponding attachment point of the second guide link 22*b* is hidden from view.

The apparatus includes a first foot link 28*a* and a second foot link 28*b*, and each foot link is pivotably connected to its respective guide link through the second attachment point thereof. Each of the foot links 28 is configured to receive and support the foot of a person using the apparatus, and toward this end preferably includes a foot pad 30*a*, 30*b* thereupon.

As further illustrated in FIG. 1, the apparatus 10 includes a first crank arm 32*a* and a second crank arm 32*b* which are pivotably attached to the frame at the second pivot axis 20, so as to be rotatable thereabout. Each crank arm 32*a*, 32*b* engages a corresponding intermediate link 34*a*, 34*b*, and each intermediate link 34 is in turn connected to a respective guide link 22.

As will be appreciated from FIG. 1, rotation of the crank arms 32 about the second pivot axis is coupled to the back and forth motion of the guide links 22 about the first pivot axis 18 by the intermediate links 34.

The apparatus 10 also includes a first and second control member, which in this instance comprises a first cable 36*a* and a second cable 36*b* which operate to vary the angle defined between the foot links 28 and their respective guide links 22 as those guide links pivot about the first pivot axis 18. The cables 36 are in mechanical communication with a reciprocation assembly, which in turn is in mechanical communication with the crank arms 32.

As specifically shown in FIG. 1, the reciprocation assembly includes a pair of cam wheels, of which only the first cam wheel 38 is visible herein, it being understood that a second generally similar cam wheel is disposed on the opposite side of the apparatus. The cam wheel 38 is supported at, and disposed so as to rotate about, the second pivot axis 20 as its associated crank 32*a* rotates thereabout. The cam wheel is contacted by a cam follower 40, which in turn is supported by a camming lever 42*a* which is pivotably supported by the frame. The cam wheel 38 defines a surface which is eccentric relative to the first pivot axis, and as the cam wheel rotates, in the direction shown by arrow A, the camming lever 42*a* is reciprocated, as is shown by double headed arrow B.

The cable 36*a* comprising the first control member has, as was previously noted, a first end thereof connected to a foot link. The cable 36*a* passes over pulley 44 mounted on the frame, and has a second end thereof attached to the first camming lever 42*a*. Therefore, as the first camming lever 42*a* reciprocates as indicated by arrow B, the cable 36*a* is pulled back and forth, as is shown by double headed arrow C. This back and forth motion of the cable 36*a* raises and lowers the associated foot link 26*a* thereby changing the angle between that foot link 26*a* and its associated guide link 22*a*.

A similar control and reciprocating assembly is disposed on the opposite side of the apparatus 10; and visible in FIG. 1 is a portion of a second cable 36*b* and a second camming lever 42*b*.

As is further shown in FIG. 1, the apparatus 10 includes a flywheel 46 which is supported by the frame 12 and is mechanically coupled to the crank arms 32 and associated cam wheel 38 via a drive chain 48 and sprocket wheel 50. As is known in the art, braking systems or motor drives may be similarly coupled to the crank arms 32*a*, 32*b*. Also, the fly wheel may be eliminated in some instances.

It will be seen from FIG. 1 that the apparatus 10 thereof interacts to provide movement of its elements wherein the back and forth motion of the guide links 22 is linked to rotation of the cam wheels 38, cranks 32 and associated flywheel 46, and that this motion further causes the activation of a control system which raises and lowers the foot links 28 relative to the guide links 22 so that the angle therebetween changes as a function of the back and forth motion of the guide links 22. This produces a beneficial elliptical path of motion wherein the heel of a person utilizing the apparatus initially rises at a faster rate than does their toe portion when the foot is on a forward stroke, and in which the user's heel initially falls at a faster rate than does the toe portion on a rearward stroke.

Figure 2:
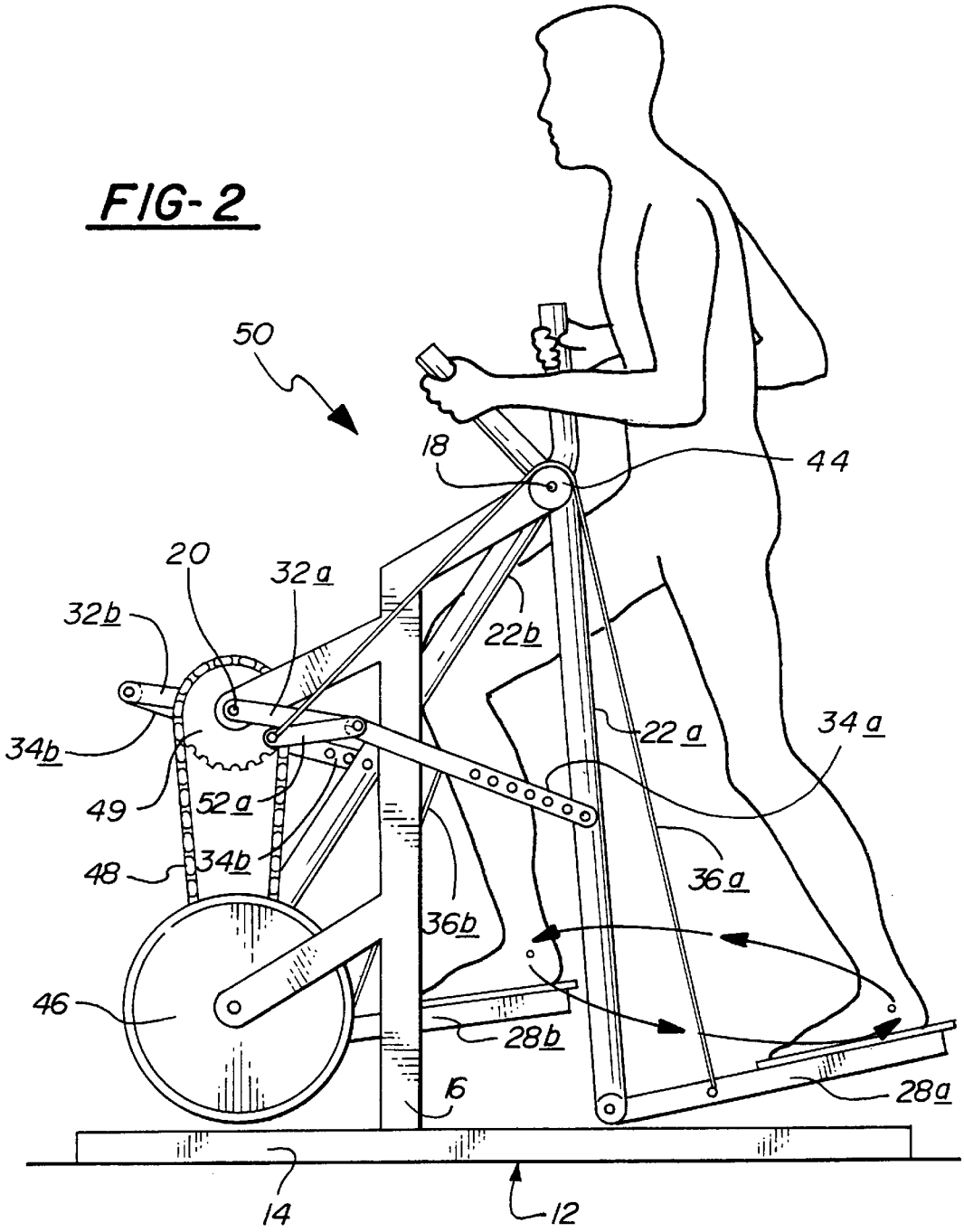
FIG. 2 is a side elevational view of a second embodiment of exercise device structured in accord with the principles of the present invention.

Yet other embodiments of the apparatus may be implemented in accord with the present invention, and embodiment 50 thereof is shown in FIG. 2. Apparatus 50 of FIG. 2 is generally similar to the apparatus 10 of FIG. 1, and accordingly, like structures will be indicated by like reference numerals.

The FIG. 2 embodiment includes a frame 12, which as previously described, includes a base 14 and an upright portion 16. The frame 12 includes a first pivot axis 18 and a second pivot axis 20 defined thereupon. The apparatus includes a first guide link 22*a* and a second guide link 22*b* pivotably attached to the frame through the first pivot axis 18. Foot links 28*a,* 28*b* are affixed to corresponding guide links 22*a,* 22*b* as previously described.

The apparatus 50 of FIG. 2 further includes a first crank arm 32*a* and a second crank arm 32*b* pivotably supported for rotation about the second pivot axis 20, and each of these crank arms 32 engages a corresponding intermediate link 34*a,* 34*b* which in turn is joined to a respective guide link 22*a,* 22*b*. As in the previous embodiment, the apparatus 50 includes a first and a second cable 36*a,* 36*b* which function as control members for varying the angular relationship of the foot links 28 and associated guide links 22. The FIG. 2 embodiment differs from the FIG. 1 embodiment with regard to the configuration of the assembly which operates to reciprocate the cables 36 and thereby control the angular relationship of the foot links 28 to the guide links 22.

In the FIG. 2 embodiment, a camming arm 52*a,* 52*b* is rigidly connected to a corresponding crank arm 32*a,* 32*b* in a fixed angular relationship thereto so that the second end of the camming arm 52, which is not affixed to the crank arm, travels about the pivot axis 20 in an eccentric path. As will be seen from FIG. 2, the cables 36*a,* 36*b* have a second end thereof affixed to the camming arm 52*a,* 52*b,* and in this manner, the eccentric motion of the second end of the camming arm 52 about the pivot axis 20 reciprocates the cable 36 along a looped path of travel. It will thus be seen that the reciprocating linkage of FIG. 2 provides a foot action generally similar to that achieved by the apparatus of FIG. 1.

It is to be noted that the FIG. 2 embodiment differs from that of FIG. 1 further insofar as the pulley 44, which guides the cable 36, is mounted at the first pivot axis 18, and not removed therefrom as in FIG. 1. Clearly, such mounting of the pulley may also be implemented in connection with the FIG. 1 embodiment. As further shown in FIG. 2, a flywheel 46 is mechanically coupled to the crank arms 32 by means of a drive chain 48 and a sprocket 49. It should also be noted that the flywheel may be dispensed with in some embodiments. In other embodiments, a driving motor may be incorporated to facilitate the motion of the exercise apparatus. In yet other instances, braking devices such as magnetic brakes, mechanical brakes or the like may be included to increase the workload obtained through use of the apparatus.

Figure 3:
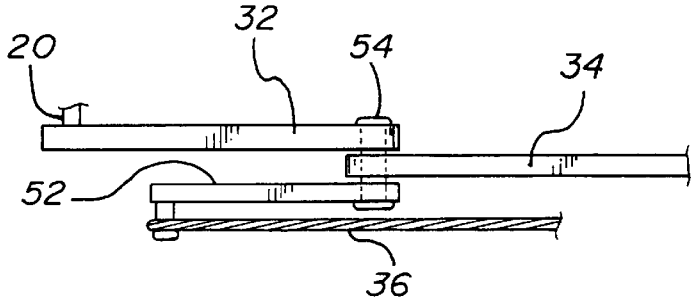
FIG. 3 is a top plan view of a crank and camming arm assembly that may be employed in some embodiments of the present invention.

Referring now to FIG. 3, there is shown a top plan view of particular elements of the reciprocation assembly of the FIG. 2 embodiment. Specifically shown in FIG. 2 is a crank arm 32 and a portion of an intermediate link 34, and a camming arm 52. As described above, the crank arm 32 and camming arm 52 are rigidly joined together so that the angular relationship therebetween is fixed. As shown in FIG. 3, this connection is accomplished by a pin 54 fixed to, and passing through, the crank arm 32 and camming arm 52. The pin 54 also passes through the intermediate link 34, but is not rigidly attached thereto so that intermediate link 34 may pivot relative to the crank arm 32 and camming arm 52. As will be further noted from FIG. 3, one end of the cable 36 is fixed to the free end of the crank arm 52, preferably so as to be pivotable thereabout.

Figure 4:
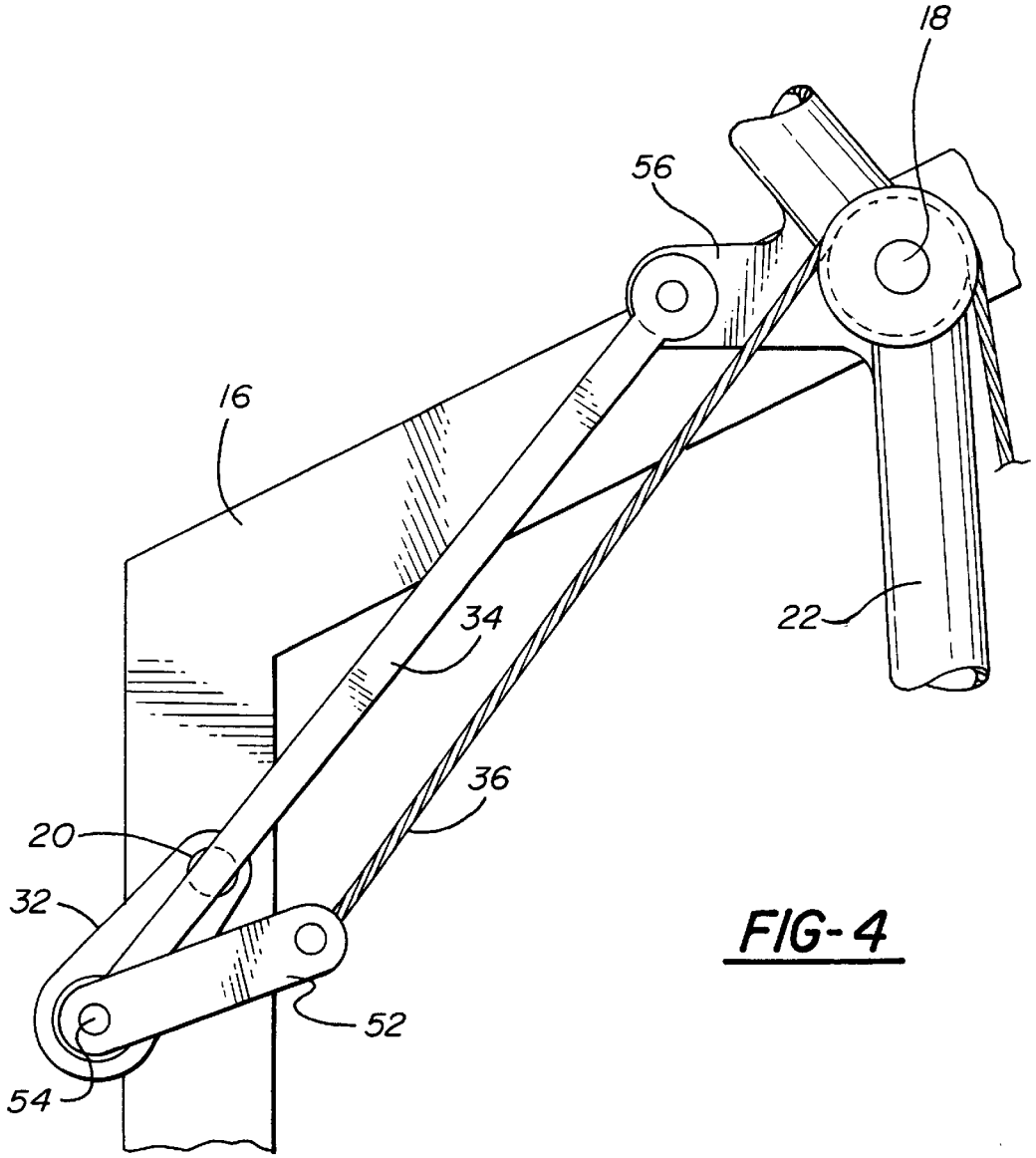
FIG. 4 is a side elevational view of a portion of an exercise device including the camming arm and crank assembly of FIG. 3.

Yet other embodiments of the present invention may be implemented. For example, FIG. 4 shows a portion of another exercise apparatus structured in accord with the principles of the present invention. FIG. 4 specifically illustrates a portion of the reciprocation assembly of an exercise device generally similar to the devices shown in FIGS. 1 and 2. The FIG. 4 embodiment depicts a portion of the upright 16 of a frame having a first, 18 and a second, 20 pivot axis defined thereupon. As previously described, the guide link 22 is pivotably supported at the first pivot axis 18, and a crank arm 32 is disposed so as to be rotatable about the second pivot axis 20. In the FIG. 4 embodiment, the intermediate link 34 has a first end joined to the crank arm 32 and a second end which pivotably engages a rocker arm 56 which projects from the guide link 22, and in this manner the back and forth motion of the guide link 22 is tied to the rotation of the crank arm 32.

As shown in FIGS. 2 and 3, a camming arm 52 is rigidly connected to the crank arm 32 via a connector pin 54. The free end of the camming arm 52 is connected to one end of a cable 36, and as the crank arm 32 rotates, the free end of the camming arm 52 travels in an eccentric path about the second pivot axis 20 and thereby reciprocates the cable 36 so as to control the angle between the foot link (not shown in this drawing) and the guide link 22. It will be appreciated that the connection between the crank arm 32 and camming arm 52 may be made to be adjustable, so that the angular relationship therebetween may be selectably varied so as to permit adjustment of the degree and timing of the reciprocation of the cable 36, which will thereby allow for adjustment of the angular variation between the foot link and guide link.

Figure 5:
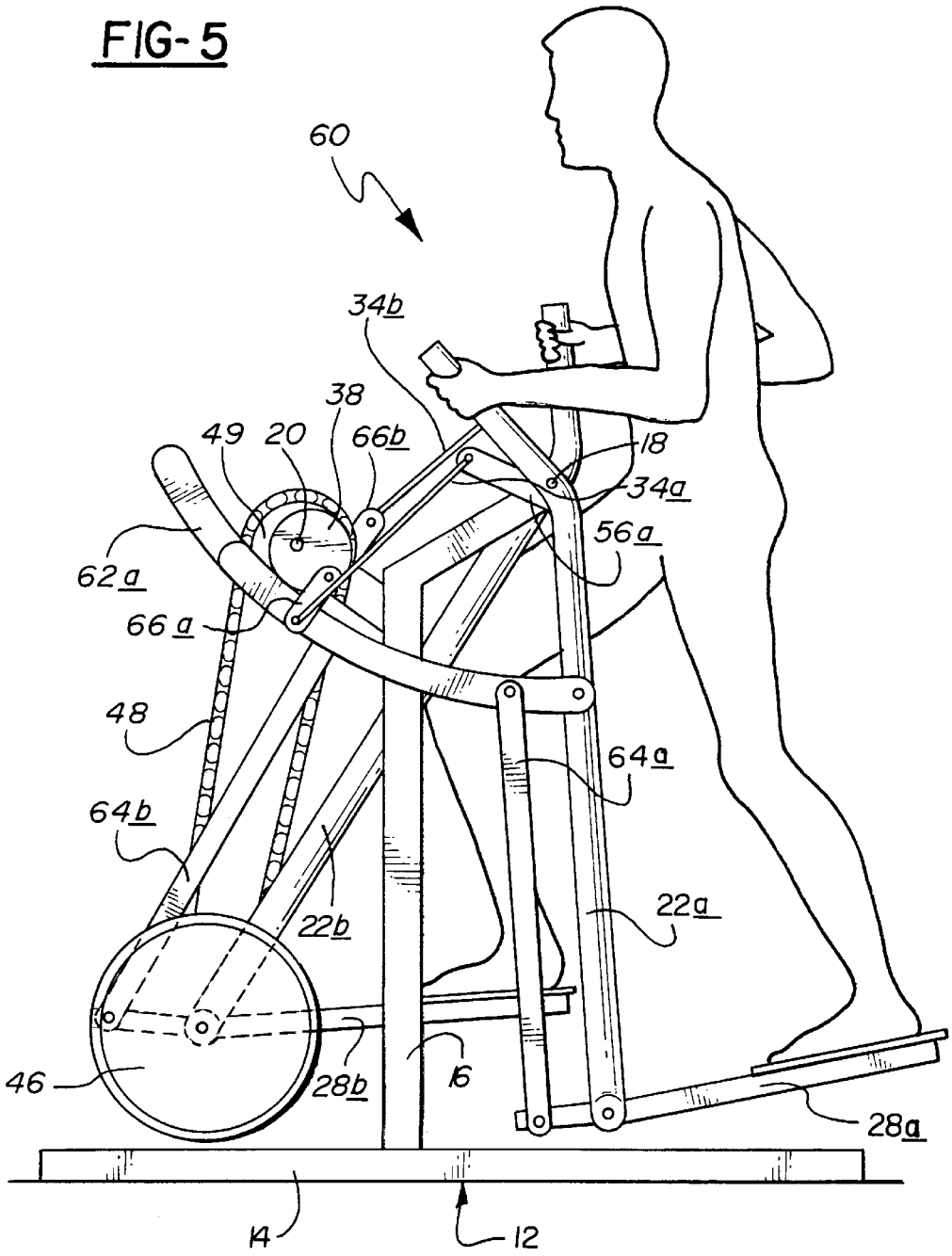
FIG. 5 is a side elevational view of another embodiment of an exercise device structured in accord with the principles of the present invention.

Still other embodiments of the present invention may be implemented. Referring now to FIG. 5 there is shown yet another embodiment of exercise apparatus 60 structured in accord with the present invention. The apparatus 60 of FIG. 5 includes a frame 12 having a base 14 and upright portion 16, with a first pivot axis 18 and a second pivot axis 20 defined thereupon. First and second guide arms 22*a,* 22*b* and associated foot links 28*a,* 28*b* are included as previously described.

The FIG. 5 embodiment differs from previous embodiments insofar as it includes a cam wheel 38 disposed for eccentric rotation about the second pivot axis 20, as is generally shown with regard to the FIG. 1 embodiment. However, the cam 38 engages a curved cam follower 62*a* which is pivotably attached to a respective guide link 22*a*. The apparatus further includes a control member which in this instance is a control link 64*a* which has a first end affixed to a respective foot link 28*a* and a second end directly affixed to the cam follower 62*a*. As the cam wheel 38 rotates about the second pivot axis 20, the cam follower 62*a* will travel therealong, and owing to the eccentric configuration of the cam wheel 38, the follower 62*a* will be also reciprocated in an up and down direction. It will transfer this reciprocal motion to the control link 64*a,* which in turn will move the foot link 28*a* up and down.

It is further to be noted that the apparatus of FIG. 5 includes crank arms 66*a,* 66*b* which each have a first end affixed to the cam 38, and a second end which is joined to a corresponding intermediate link 34*a,* 34*b,* which in turn is coupled to its respective guide link 22*a,* 22*b* by a corresponding first rocker arm portion 56*a,* and a second rocker arm portion. As in the previous embodiments, flywheel 46 may be included, and is preferably coupled to the cam 38 by a drive chain 48 and a sprocket 49.

It will be appreciated from FIG. 5 that the back and forth motion of the first links 22 is tied to the rotation of the crank arms 66 and cams 38, which in turn are mechanically coupled to the cam followers 62 and control links 64 so that the angle between the foot links 28 and control links 64 is varied as a function of the back and forth motion of the control links 22 so as to provide the user with desirable foot action.

Yet other variations of the FIG. 5 embodiment may be implemented. For example, the rigid control link 64 may be replaced with a cable, chain or other nonrigid link, and in such instance, the cam follower 62 will be extended beyond the point where it is connected to the guide link 22, and the cable, chain or like member will run from this extension portion down to the foot link to establish connection thereto inboard of the connection between the foot link and guide link, in a manner similar to that shown in FIGS. 1 and 2.

Yet other variations on the apparatus of the present invention may be implemented. For example, the intermediate link may be dispensed with in some instances, since sufficient synchronization of the guide link, foot link and control member can be achieved through the remaining linkages, or mechanical equivalents thereof. Also, the connection points between the various linkages of the present invention may be made to be adjustable, as is shown in various of the figures, so as to accommodate users of different sizes and/or to provide modified actions. In other instances, the shape and/or size of the cam can be altered to change the shape of the foot action achieved by the apparatus. As noted, in various embodiments, the cables and links may be interchangeably substituted by appropriate repositioning and adjustment of the connection points as will be apparent to one of skill in the mechanical arts. All of the different features and variations shown in the foregoing figures and discussed hereinabove may be interchangeably substituted to produce various exercise apparatus in accord with the present invention.

In view of the foregoing, it is to be understood that numerous modifications and variations of the present invention may be practiced, in forms other than those specifically illustrated herein. All of such modifications and variations are within the scope of the present invention. It is the following claims, including all equivalents, which define the scope of the invention.

I claim:

1. An exercise device comprising:

a frame configured to be supported on a floor, said frame having a first and a second pivot axis defined thereupon;

a first and a second guide link, each guide link having a first and a second attachment point defined thereupon, each guide link being pivotally attached, through its first attachment point, to said frame at the first pivot axis thereof;

a first and a second foot link, each foot link being pivotally attached to a respective one of said first and second guide links through the second attachment point thereof;

a first and a second crank arm, each being pivotally attached to said frame at said second pivot axis so as to be rotatable thereabout;

a first and a second intermediate link, each having a first connection point mechanically coupled to a respective one of said guide links, and a second connection point mechanically coupled to a respective one of said crank arms, so that rotation of said first and second crank arms about said second pivot axis causes said respective first and second guide links to pivot about said first pivot axis;

a first and a second control member, each having a first junction point affixed to a respective one of said foot links;

first and second reciprocating means, each in mechanical communication with a respective one of said crank arms and with a second junction point defined on a respective one of said first and second control members, each of said reciprocating means being operable to reciprocate the second junction point of its respective control member as its respective crank arm rotates about the second pivot axis, so that its respective control member is operative to vary an angle defined between its respective foot link and its associated guide link, as said guide link pivots about said first pivot axis.

2. An exercise device as in claim 1, wherein said first and second reciprocating means each include a cam wheel which is mechanically coupled to a respective one of said crank arms, and which rotates about said second pivot axis therewith; and a cam follower which engages said cam wheel, and which is in mechanical communication with the second junction point of its respective control member.

3. An exercise device as in claim 2, wherein each reciprocating means further includes a camming lever which is connected to a respective one of said control members at the second junction point thereof and wherein each cam follower engages a respective one of said camming levers so as to establish mechanical communication with its respective control member.

4. An exercise device as in claim 2, wherein each cam follower is connected to its respective control member at the junction point thereof.

5. An exercise device as in claim 4, wherein each cam follower comprises a curved member.

6. An exercise device as in claim 1, wherein said reciprocating means each comprise a camming arm fixed to a respective one of said crank arms, in an angled relationship thereto.

7. An exercise device as in claim 1, wherein said first and second junction points are adjustable.

8. An exercise device as in claim 1, wherein said first and second control members each comprise a cable.

9. An exercise device as in claim 8, further including a first pulley which engages said first control member at a point between the first junction point and the second junction point thereof, and a second pulley which engages the second control member at a point between the first junction point and the second junction point thereof.

10. An exercise device as in claim 1, wherein said first and second control members each comprise a rigid link.

11. An exercise device as in claim 1, further including a flywheel in mechanical engagement with said first and second crank arms.

12. An exercise device comprising:

a frame configured to be supported on a floor, said frame having a first and a second pivot axis defined thereupon;

a first and a second guide link, each guide link having a first and a second attachment point defined thereupon, each guide link being pivotally attached, through its first attachment point, to said frame at the first pivot axis thereof;

a first and a second foot link, each foot link being pivotally attached to a respective one of said first and second guide links through the second attachment point thereof;

a first and a second crank arm, each being pivotally attached to said frame at said second pivot axis so as to be rotatable thereabout;

a first and a second intermediate link, each having a first connection point mechanically coupled to a respective one of said guide links, and a second connection point mechanically coupled to a respective one of said crank arms, so that rotation of said first and second crank arms about said second pivot axis causes said respective first and second guide links to pivot about said first pivot axis; and control means in mechanical communication with said first and second foot links, for varying an angle defined between each of said foot links and its respective guide link as said guide link pivots about said first pivot axis.

13. An exercise device comprising:

a frame configured to be supported on a floor, said frame having a first and a second pivot axis defined thereupon;

a first and a second guide link, each guide link having a first and second attachment point defined thereupon, each guide link being pivotably attached, through its first attachment point, to said frame at said pivot axis thereof;

a first and a second foot link, each foot link being pivotably attached to a respective one of the first and second guide links, through the second attachment point thereof;

a first and a second crank arm, each being pivotably attached to said frame at said second pivot axis so as to be rotatable thereabout; and control means in mechanical communication with said first and second foot links and in mechanical communication with said crank arms by means of a cam, said control means being operable to vary an angle defined between each of said foot links and its respective guide link as said guide link pivots about said first pivot axis.

14. An exercise device comprising a frame configured to be supported on a floor, said frame having a first and a second pivot axis defined thereupon;

a first and a second guide link, each guide link having a first and a second attachment point defined thereupon, each guide link being pivotably attached, through its first attachment point, to said frame at the first pivot axis thereof;

a first and a second foot link, each foot link being pivotably attached to a respective one of said first and second guide links through the second attachment point thereof;

a first and a second control member, each having a first junction point affixed to a respective one of said foot links; and first and second reciprocating means, each in mechanical communication with a second junction point defined on a respective one of said first and second control members, each of said reciprocating means including a camming member and being operable to reciprocate the second junction point of its respective control member as its respective guide link pivots about said first pivot axis so that its respective control member will vary an angle defined between its respective foot link and its associated guide link.

* * * * *